US008634179B2

(12) United States Patent
Rubinshtein

(10) Patent No.: US 8,634,179 B2
(45) Date of Patent: Jan. 21, 2014

(54) HOT SURFACE RE-IGNITION CONTROLLER

(76) Inventor: Peter Rubinshtein, Unley Park (AU)

( * ) Notice: Subject to any disclaimer, the term of this patent is extended or adjusted under 35 U.S.C. 154(b) by 621 days.

(21) Appl. No.: 12/906,083

(22) Filed: Oct. 16, 2010

(65) Prior Publication Data

US 2012/0094240 A1 Apr. 19, 2012

(51) Int. Cl.
*F23Q 7/00* (2006.01)

(52) U.S. Cl.
USPC ..... 361/264

(58) Field of Classification Search
USPC ..... 361/264
See application file for complete search history.

(56) References Cited

U.S. PATENT DOCUMENTS

| | | | | | |
|---|---|---|---|---|---|
| 4,024,412 | A * | 5/1977 | MacAskill, Jr. | ..... | 307/117 |
| 4,323,342 | A * | 4/1982 | Sommers et al. | ..... | 431/66 |
| 4,406,612 | A * | 9/1983 | Donnelly | ..... | 431/71 |
| 4,457,701 | A * | 7/1984 | Gaiffier | ..... | 431/24 |
| 5,538,416 | A * | 7/1996 | Peterson et al. | ..... | 431/46 |
| 6,126,435 | A * | 10/2000 | Fredin-Garcia et al. | ..... | 431/14 |
| 6,777,653 | B2 * | 8/2004 | Burkhart | ..... | 219/497 |
| 2012/0094240 | A1 * | 4/2012 | Rubinshtein | ..... | 431/28 |

* cited by examiner

*Primary Examiner* — Ronald W Leja
(74) *Attorney, Agent, or Firm* — Bio Intellectual Property Services LLC (Bio IPS); O. M. (Sam) Zaghmout

(57) ABSTRACT

A hot surface re-ignition controller for use with a transformer for powering a hot surface igniter in a gas appliance. The design includes flame detection circuitry for interfacing with flame detecting electrodes and is completely implemented in analog circuitry to provide reliable operation in harsh environments.

14 Claims, 1 Drawing Sheet

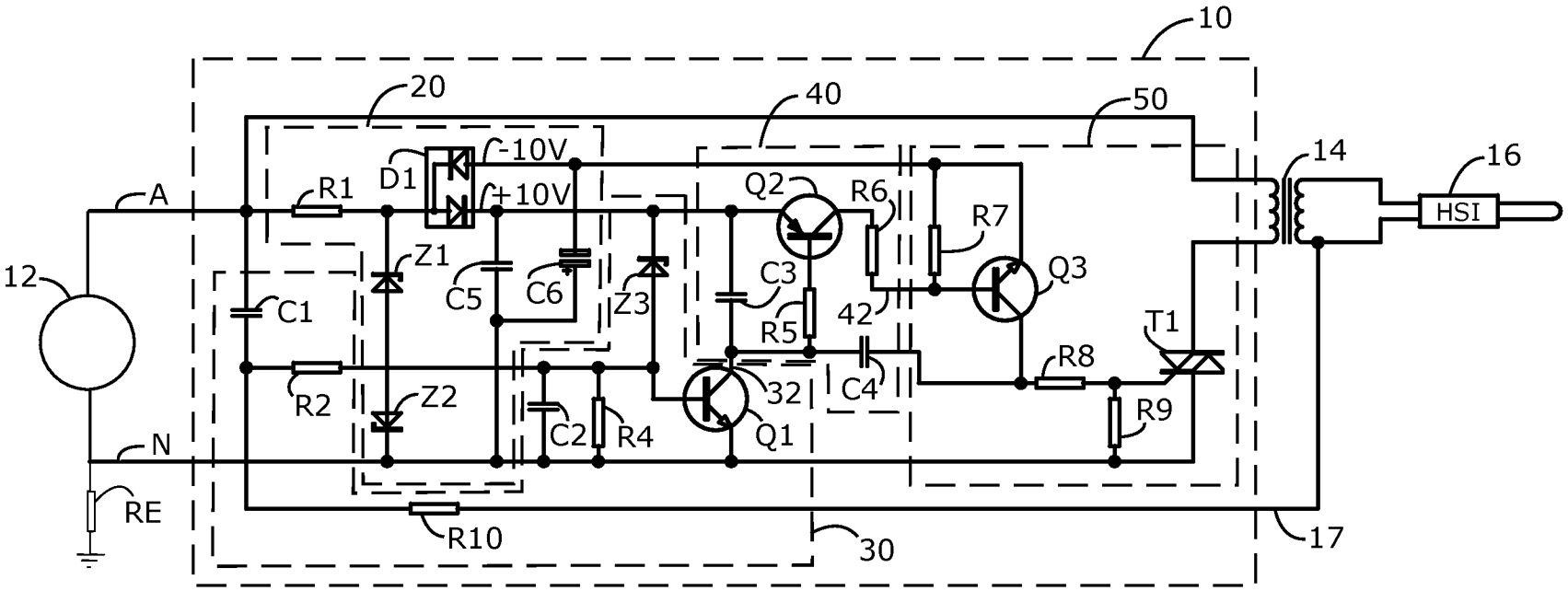
16
HSI
14
17
10
50
T1
R9
R8
Q3
R7
R6
42
C4
30
40
Q2
C3
R5
32
Q1
Z3
R4
C2
-10V
+10V
C6
C5
R10
20
D1
Z1
Z2
R1
C1
R2
A
N
RE
12

HOT SURFACE RE-IGNITION CONTROLLER

FIELD OF THE INVENTION

This invention relates to a hot surface re-ignition controller, in particular a hot surface re-ignition controller for use with a transformer for powering a hot surface igniter in a gas appliance.

BACKGROUND TO THE INVENTION

Hot surface igniters have become increasingly popular as a means for lighting gas appliances with a subsequent demand for suitable control mechanisms for them. Many controllers have been developed, but they suffer from a range of problems. To achieve the required functionality complicated circuits have been developed, typically based around microcontrollers. Such circuits are expensive to produce and unreliable in operation due to the environmentally challenging and electrically noisy environments in which they must operate. Such circuits often have difficulty in detecting flame loss and have a flame restoration time greater than the 4 seconds required to meet the appropriate standards.

The object of this invention is to provide a re-ignition controller that alleviates the above problems, or at least provides the public with a useful alternative.

SUMMARY OF THE INVENTION

Therefore in one form of the invention there is proposed a hot surface re-ignition controller made entirely from analog components for controlling power to a hot surface igniter from an AC mains supply.

Preferably the controller switches power to the igniter in response to a flame sensing signal from the igniter.

In preference the power to the igniter is supplied via an isolation transformer.

Preferably the controller uses a triac to switch power to the transformer and incorporates positive feedback for switching the triac between on and off states in less than 1 cycle of the AC mains supply.

Preferably the controller applies power to the igniter as soon as power is applied to the controller, after which power is maintained to the igniter until after the flame sensing signal indicates a flame is present for at least 5 seconds, after which power is removed from the igniter.

Advantageously power is applied to the igniter in response to a loss in the flame sensing signal, after which power is maintained to the igniter until after the flame sensing signal indicates a flame is present for at least 5 seconds, after which power is removed from the igniter.

In preference the power for the controller is derived from the AC mains supply input without the use of an isolating transformer.

Preferably the controller is encapsulated in epoxy resin to protect the controller circuitry from current leakage.

In preference the controller comprises:

a power supply block;

a flame detector block;

a signal amplifier and delay block; and a triac driver block

Preferably each block is comprised solely of analog components

In preference the signal amplifier and delay block comprises a transistor performing the function of amplification, time delay and level shifting.

Preferably a capacitor is used to provide positive feedback from the triac driver block to the signal amplifier and delay block such that the triac driver block is able to switch a triac between on and off states in less than 1 cycle of the AC mains supply.

It should be noted that any one of the aspects mentioned above may include any of the features of any of the other aspects mentioned above and may include any of the features of any of the embodiments described below as appropriate.

BRIEF DESCRIPTION OF THE DRAWINGS

The accompanying drawings, which are incorporated in and constitute a part of this specification, illustrate various implementations of the invention and, together with the description, serve to explain the advantages and principles of the invention. In the drawings:

FIG. 1 is a schematic diagram of a preferred embodiment of the invention.

| LIST OF COMPONENTS AND SIGNALS | |
|---|---|
| 10 | Hot Surface Re-ignition Controller (HSRC) |
| 12 | AC power supply |
| 14 | Transformer |
| 16 | Hot Surface Igniter (HSI) |
| 17 | Flame sensing signal |
| 20 | Power supply block |
| 30 | Flame detector block |
| 32 | Flame detection signal |
| 40 | Signal amplifier and delay block |
| 42 | Triac driver control signal |
| 50 | Triac driver block |
| A | Active signal (of AC power supply) |
| N | Neutral signal (of AC power supply) |

DETAILED DESCRIPTION OF PREFERRED EMBODIMENT

The following detailed description of the invention refers to the accompanying drawings. Wherever possible, the same reference numbers will be used throughout the drawings and the following description to refer to the same and like parts.

FIG. 1 shows a hot surface re-ignition controller (HSRC) 10 as used in a gas appliance such as a cooktop, oven or water heater. The HSRC 10 controls the supply of power from an AC power supply 12 to a transformer 14 for powering a hot surface igniter (HSI) 16 in response to a flame sensing signal 17 from flame sensing electrodes of the HSI 16.

The HSRC 10 can be functionally decomposed into 4 circuit blocks: power supply block 20; flame detector block 30; signal amplifier and delay block 40; and triac driver block 50. The circuits use the neutral signal N of the AC power supply 12 as a reference voltage.

The power supply block 20 converts the active signal A of the AC power supply 12 to positive and negative DC power rails +10V and −10V. The power supply 20 is a dual Zener regulator comprising voltage dropping resistor R1, back to back Zener diodes Z1 and Z2, rectifying diodes D1 and filter capacitors C5 and C6.

The flame detector block 30 produces a flame detection signal 32 in response to a flame sensing signal 17.

The flame detector block 30 connects to a flame sensing signal 17 which is produced by heating electrodes of the HSI 16 by the well known flame rectification phenomena. To produce the flame sensing signal 17 the HSI 16 is supplied with an AC signal from the AC power supply 12 via isolating capacitor C1 and safety resistor R10. The capacitor C1 provides galvanic isolation making flame rectification circuit operation possible. In response to a flame, the flame sensing signal 17 is a negative rectified DC current varying from 100-200 nA for a low flame to 4-10 uA for a high flame.

The flame detector block 30 is based around transistor Q1, which in the absence of a flame sensing signal 17 will switch on and off in line with the AC supply 12. The active signal A of the AC power supply 12 is fed to the base of Q1 via a divider network consisting of capacitors C1 and C2 and resistors R2 and R4 to create a 3.5 Vac peak—peak signal which is clamped to a peak value of 0.6V by the base of Q1. When a flame sensing signal 17 is present it will pull down the base of Q1, turning Q1 off to indicate the presence of a flame via flame detection signal 32. Zener diode Z3 limits how far the base of Q1 can be pulled down to −6V to ensure the safety of Q1 base and that when the flame sensing signal 17 disappears, that Q1 will be able to turn back on again quickly to indicate the lack of a flame via the flame detection signal 32. When the AC power 12 is first applied to the flame detector block the flame sensing signal 17 will switch on and off in line with the AC supply 12 to ensure that the HSRC 10 acts to switch power to the HSI 16 to ensure a failsafe start up condition until a flame is detected.

The signal amplifier and delay block 40 ensures that when there is no flame detected that the HSRC 10 switches power to the HSI 16 until a flame is detected, after which power is maintained for approximately 5 seconds to ensure reliable operation of the HSI 16.

The signal amplifier and delay block 40 comprises transistor Q2, capacitors C3 and C4 and resistors R5 and R6. The signal amplifier and delay block 40 performs three functions: amplifying the current from the flame detection signal 32 to produce the triac driver control signal 42, providing a time delay of approximately 5 seconds to keep the HSI 16 switched on whilst the flame is establishing; and level shifting between the 0 to +10V flame detection signal 32 to 0 to −10V for the triac driver control signal 42. The time delay of approximately 5 seconds is determined by the RC time constant of capacitor C3 and resistor R5. Capacitor C4 provides positive feedback to ensure quick and reliable switching of the triac driver control signal 42 between on and off states in less than 1 AC mains cycle.

The triac driver block 50 ensures fast and reliable switching of the triac T1 used to switch power to the HSI 16.

The triac driver block 50 uses the triac driver control signal 42 to control the switching of a transistor Q3 which in turn controls the operation of a triac T1. The appropriate gate current for the triac is set by R8 to approximately 5 mA for reliable operation. The triac T1 switches the neutral signal N of the AC power supply 12 to the transformer 14 thus controlling power to the HSI 16.

The HSI 16 receives its power from the secondary side of step down transformer 14. The primary side of transformer 12 is connected between the active signal A of the AC power supply 12 and the triac T1, thus allowing the supply of AC power to the HSI 16 to be controlled by the HSRC 10.

As the flame detector block 30 of the HSRC 10 incorporates a very high impedance circuit, physical protection of the circuit from current leakage, shortages and other signal losses is required. This is achieved by encapsulating the HSRC 10 in flame retardant epoxy resin. This encapsulation also ensures that the HSRC 10 is suitable for use in physically adverse conditions where high temperatures or moisture and other non-friendly environments may be encountered.

The galvanic coupling between N and earth is needed for reliable flame sensing. In some power delivery systems direct contact between N and earth is prohibited. As shown if FIG. 1 an artificial dedicated resistor RE may be implemented, preferably RE is between 10 Ohms and 1M Ohms.

From the foregoing description it can be seen that the invention provides a simple and robust HSRC design capable of providing reliable performance in the challenging environment of a gas appliance. Being a completely analog design the HSRC neither produces nor is susceptible to electrical noise.

Component values of the HSRC can be adapted to work from various AC supply voltages. The following table lists component values for 240 Vac and 120 Vac operation.

| Component | 120Vac | 240Vac |
|---|---|---|
| C1 | 10n | 10n |
| C2 | 47n | 68n |
| C3 | 100n | 100n |
| C4 | 100n | 100n |
| C5 | 1u0 | 1u0 |
| C6 | 22u | 22u |
| D1 | BAV99 | BAV99 |
| Q1 | BC847 | BC847 |
| Q2 | BC857 | BC857 |
| Q3 | BC847 | BC847 |
| R1 | 13k2 | 28k2 |
| R2 | 5M4 | 8M3 |
| R4 | 8M2 | 8M2 |
| R5 | 8M2 | 8M2 |
| R6 | 100k | 100k |
| R7 | 100k | 100k |
| R8 | 3k3 | 3k3 |
| R9 | 10k | 10k |
| R10 | 2M7 | 2M7 |
| RE | 10R < RE < 1M | 10R < RE < 1M |
| T1 | Z0103MN | Z0103MN |
| Z1 | BZX84C10 | BZX84C10 |
| Z2 | BZX84C10 | BZX84C10 |
| Z3 | BZX84C16 | BZX84C16 |

Further advantages and improvements may very well be made to the present invention without deviating from its scope. Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus. Any discussion of the prior art throughout the specification should in no way be considered as an admission that such prior art is widely known or forms part of the common general knowledge in this field.

In the summary of the invention, except where the context requires otherwise due to express language or necessary implication, the word "comprising" is used in the sense of "including", i.e. the features specified may be associated with further features in various embodiments of the invention.

The invention claimed is:

1. A hot surface re-ignition controller for controlling the switching of an AC mains supply to a hot surface igniter in response to a flame sensing signal from the igniter comprising:

a power supply block;

a flame detector block;

a signal amplifier and delay block; and a triac driver block, wherein the signal amplifier and delay block comprises a transistor performing the function of amplification, time delay and level shifting.

2. A controller as in claim 1, wherein the power to the igniter is supplied via an isolation voltage matching transformer.

3. A controller as in claim 2, wherein the controller uses a triac to switch power to the transformer.

4. A controller as in claim 3, wherein the controller incorporates positive feedback for quickly switching the triac between on and off states.

5. A controller as in claim 4, wherein the triac switches between on and off states in less than 1 cycle of the AC mains supply.

6. A controller as in claim 1, wherein the controller applies power to the igniter as soon as power is applied to the controller.

7. A controller as in claim 6, wherein after power is applied to the igniter, power is maintained to the igniter until after the flame sensing signal indicates a flame is present for at least 5 seconds, after which power is removed from the igniter.

8. A controller as in claim 1, wherein power is applied to the igniter in response to a loss in the flame sensing signal.

9. A controller as in claim 8, wherein after power is applied to the igniter, power is maintained to the igniter until after the flame sensing signal indicates a flame is present for at least 5 seconds, after which power is removed from the igniter.

10. A controller as in claim 1, wherein power for the controller is derived from the AC mains supply input without the use of an isolating transformer.

11. A controller as in claim 1, wherein the controller is encapsulated in flame retardant epoxy resin to protect the controller circuitry from current leakage.

12. A controller as in claim 1, wherein each block is comprised solely of analog components.

13. A controller as in claim 1, wherein a capacitor is used to provide positive feedback from the triac driver block to the signal amplifier and delay block such that the triac driver block is able to switch a triac between on and off states in less than 1 cycle of the AC mains supply.

14. A controller as in claim 1, wherein a Zener diode is used clamp the excursion of signal voltages to protect active components and to reduce the time taken to respond to the loss of a flame sensing signal.

* * * * *